US009812807B2

(12) United States Patent
Matsuura

(10) Patent No.: US 9,812,807 B2
(45) Date of Patent: Nov. 7, 2017

(54) CONNECTOR

(71) Applicant: Sumitomo Wiring Systems, Ltd., Yokkaichi, Mie (JP)

(72) Inventor: Masahito Matsuura, Mie (JP)

(73) Assignee: SUMITOMO WIRING SYSTEMS, LTD., Yokkaichi, Mie (JP)

( * ) Notice: Subject to any disclaimer, the term of this patent is extended or adjusted under 35 U.S.C. 154(b) by 26 days.

(21) Appl. No.: 14/992,116

(22) Filed: Jan. 11, 2016

(65) Prior Publication Data

US 2016/0211604 A1 Jul. 21, 2016

(30) Foreign Application Priority Data

Jan. 16, 2015 (JP) ..... 2015-006466

(51) Int. Cl.
*H01R 13/502* (2006.01)
*H01R 13/64* (2006.01)
*H01R 13/629* (2006.01)

(52) U.S. Cl.
CPC ..... *H01R 13/502* (2013.01); *H01R 13/64* (2013.01); *H01R 13/62933* (2013.01)

(58) Field of Classification Search
CPC ..... H01R 13/62938; H01R 13/62933; H01R 13/633; H01R 13/635; H01R 23/7005
USPC ..... 439/157, 372, 152, 153, 155, 160
See application file for complete search history.

(56) References Cited

U.S. PATENT DOCUMENTS 6,250,937 B1 * 6/2001 Okabe ..... H01R 13/62955 439/157

FOREIGN PATENT DOCUMENTS

JP 2002-329555 11/2002

* cited by examiner

*Primary Examiner* — Phuong Chi T Nguyen
(74) *Attorney, Agent, or Firm* — Gerald E. Hespos; Michael J. Porco; Matthew T. Hespos

(57) ABSTRACT

A connector assembly has a first connector (10) fit into a receptacle (44A) of a second connector (40). An erroneous connection preventing rib (22) and two fitting ribs (21) are provided on an outer surface of a housing (12) of the first connector (10). The erroneous connection preventing rib (22) can enter a groove (47) on an inner surface of the receptacle (44A) during proper connection of the first and second connectors (10, 40), but collides with the receptacle (44A) during erroneous connection. The fitting ribs (21) fit into fitting grooves (48) on the inner surface of the receptacle (44A) both during the proper connection and during the erroneous connection. The fitting ribs (21) fit into the fitting grooves (48) before the collision of the erroneous connection preventing rib (22) with the receptacle (44A) during the erroneous connection.

10 Claims, 12 Drawing Sheets

CONNECTOR

BACKGROUND

1. Field of the Invention

The invention relates to a connector.

2. Description of the Related Art

A known connector assembly has a first connector fit into a receptacle of a second connector. Some of assemblies of this type include an erroneous connection preventing rib on an outer side surface of the first connector to prevent the first connector from being inserted in a wrong second connector or in a wrong orientation.

Japanese Unexamined Patent Publication No. 2002-329555 discloses a connector assembly with an erroneous connection preventing rib projecting on a front end part of the first connector and the first connector can be connected to the second connector by inserting the erroneous connection preventing rib into a groove in a receptacle when the connectors are connected in proper orientations. Conversely, the erroneous connection preventing rib collides with the front of the receptacle to obstruct connection when if the connectors are in improper orientations. However, the connectors may be inclined obliquely and a part of the first connector may enter the receptacle when the erroneous connection preventing rib collides with the receptacle.

The present invention was completed based on the above situation and aims to provide a connector capable of preventing a first connector from being inclined obliquely to enter a receptacle of a second connector when an erroneous connection preventing rib collides with the receptacle.

SUMMARY

The invention is directed to a connector configured so that a connector is fit into a receptacle of a second connector. An erroneous connection preventing rib is provided on the first connector and is configured to enter a groove on an inner surface of the receptacle during proper connection to the second connector and to collide with the receptacle during erroneous connection. Two fitting ribs are formed on an outer surface of the housing of the first connector and fit into two fitting grooves on an inner surface of the receptacle both during the proper connection and during the erroneous connection. The fitting ribs are fit into the pair of fitting grooves before the collision of the erroneous connection preventing rib with the receptacle during the erroneous connection.

According to the invention, the fitting ribs are fit into the fitting grooves to correct a posture of the first connector before the erroneous connection preventing rib collides with the receptacle during an attempt to connect the connectors erroneously. Thus, the first connector cannot enter the receptacle at an oblique inclination when the erroneous connection preventing rib collides with the receptacle.

The erroneous connection preventing rib and the fitting ribs may be provided on an upper or lower surface of the housing and a guide groove may be provided on a left or right surface of the housing for receiving a guide rib projecting on an inner surface of the receptacle both during the proper connection and during the erroneous connection. The guide rib is fit into the guide groove before the collision of the erroneous connection preventing rib with the receptacle during the erroneous connection. According to this configuration, the guide rib fits into the guide groove and the fitting ribs fit into the fitting grooves before the erroneous connection preventing rib collides with the receptacle during an attempt to connect the connectors erroneously. Thus, the first connector is prevented more reliably from entering the receptacle obliquely.

The guide rib may extend long in a connecting direction. Thus, the connectors can be connected in correct postures since the posture of the first connector is prevented from being inclined during connection to the second connector.

A lever may be provided on the upper or lower surface of the housing and may be operated during connection to or separation from the second connector. The guide groove may be provided close to the lever. According to this configuration, the guide rib and the guide groove contact in the connecting direction at the position close to the lever, i.e. at the position where the first connector tends to be inclined forward due to the operation of the lever. Thus, the inclination of the postures of the connectors can be prevented when the connectors are connected.

Front ends of the fitting ribs in the connecting direction may be located before the front end of the erroneous connection preventing rib in the connecting direction. Thus, the fitting ribs are fit into the fitting grooves before the erroneous connection preventing rib collides with the receptacle even if the front end surface of the receptacle is flat. Accordingly, the front end surface of the receptacle can be a flat surface without unevenness.

DETAILED DESCRIPTION

Figure 1:
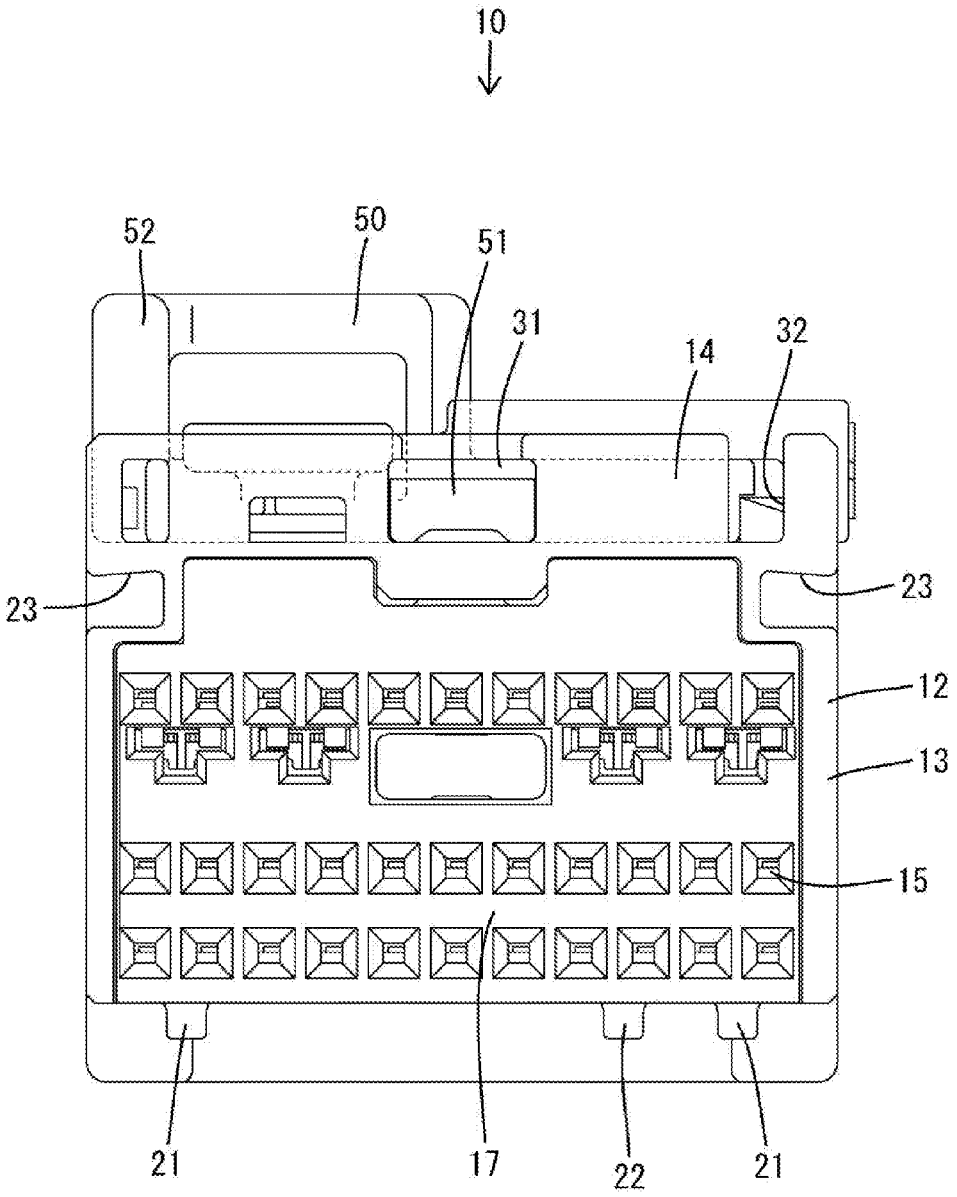
FIG. 1 is a front view showing a first connector in an embodiment.

One specific embodiment of the invention is described in detail with reference to FIGS. 1 to 12. A connector in this embodiment is configured such that a first connector 10 is fit into a receptacle 44A of a second connector 40. The first connector 10 includes a lever 50 rotated during connection to or separation from the second connector 40. In the following description, a connection surface of each constituent member is referred to as the front, and an upper side and a lower side in FIG. 6 are referred to as an upper side and a lower side.

The second connector 40 is a board connector to be fixed to a board and includes a second housing 41 made of synthetic resin and male terminal fittings (hereinafter, second terminal fittings 42) bent into an L shape.

Figure 3:
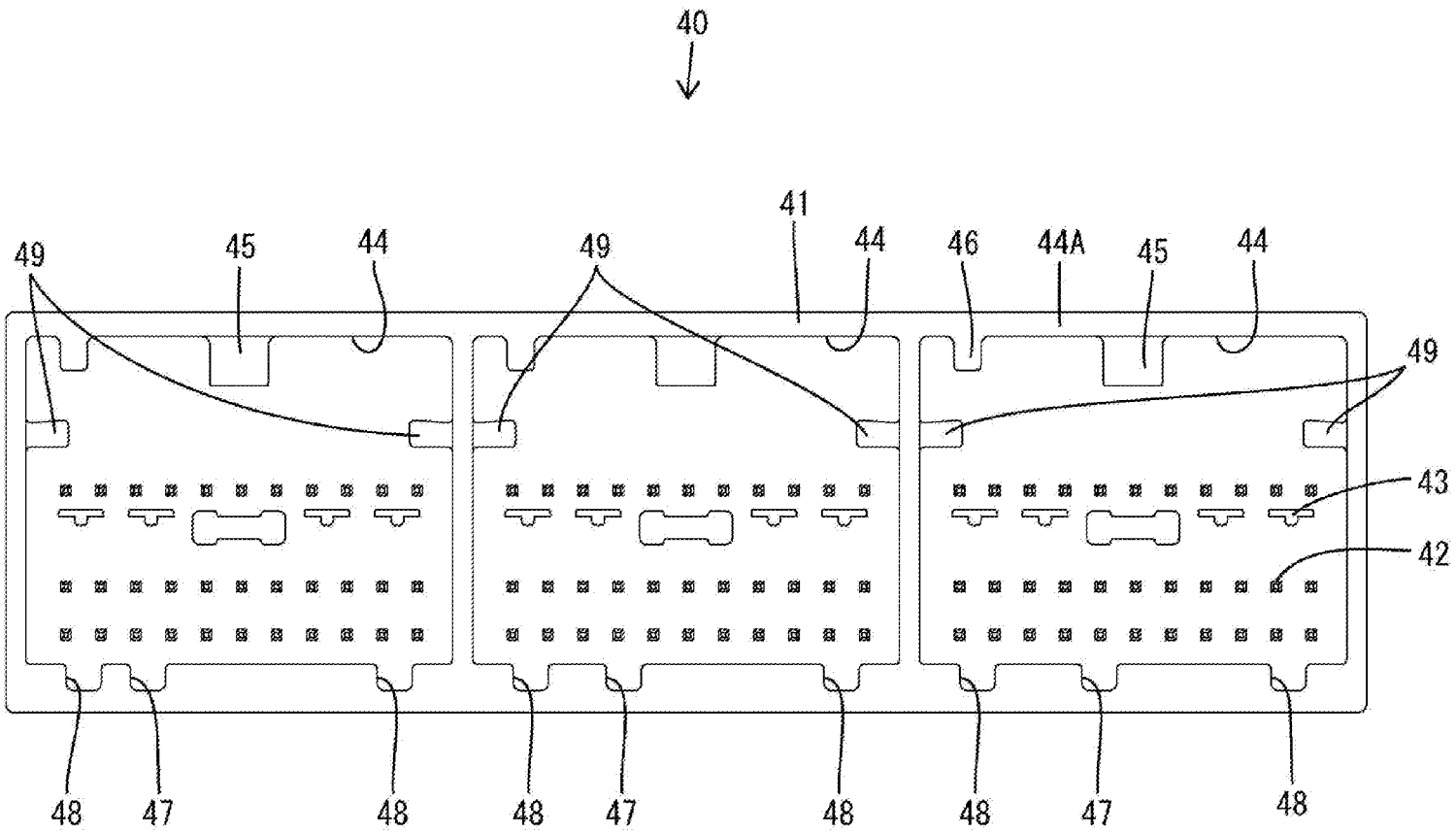
FIG. 3 is a front view showing a second connector.

As shown in FIG. 3, the second housing 41 is wide in a lateral direction, and a plurality of (three in this embodiment) connector fitting portions 44 are provided side by side in the lateral direction for receiving the first connectors 10.

Each connector fitting portion 44 includes the forwardly open receptacle 44A, and the first connector 10 is fit into this receptacle 44A. The second terminal fittings 42 are mounted in each connector fitting portion 44 in a state where tip parts thereof project into the receptacle 44A. Further, short releasing portions 43 project into the receptacle 44A of each connector fitting portion 44 for releasing a shorted state of female first terminal fittings 11 in the first connector 10 by unillustrated shorting terminals in the process of connecting the first connector 10.

A cylindrical cam pin 45 projects down from the upper wall of the receptacle 44A of each connector fitting portion 44 toward an inner space of the receptacle 44A. The cam pin 45 is provided at a position closer to a front end than a center in a front-back direction of the receptacle 44A (see FIG. 6).

Further, a lock releasing portion 46 projects down from the upper wall of the receptacle 44A of each connector fitting portion 44 for releasing the initial locking of the lever 50. As shown in FIG. 6, the lock releasing portion 46 extends straight in the front-back direction from the front end to the rear end of the receptacle 44A.

A groove 47 and fitting grooves 48 are provided on the lower wall of each connector fitting portion 44 (see FIG. 3). The groove 47 receives erroneous connection preventing rib 22 that projects on the lower surface of the first connector 10, and the fitting grooves 48 receive fitting ribs 21 that project on the lower surface of the first connector 10. The groove 47 and the fitting grooves 48 are described in detail later.

Guide ribs 49 project on the inner peripheral surface of the receptacle 44A. The guide ribs 49 also are described in detail later.

The first connector 10 includes a first housing 12 made of synthetic resin, the first terminal fittings 11 and unillustrated shorting terminals for shorting two adjacent first terminal fittings 11.

Each shorting terminal is in contact with a corresponding pair of the first terminal fittings 11 to short them before the first connector 10 is connected to the second connector 40. The short releasing portion 43 of the second housing 41 brings the shorting terminal and the first terminal fittings 11 out of contact to release the shorted state of the first terminal fittings 11 when the first connector 10 is connected to the second connector 40.

The first housing 12 is formed into a substantially rectangular block shape that can fit into the receptacle 44A of the second housing 41 and includes a terminal accommodating portion 13 for accommodating the first terminal fittings 11 and a lever accommodating portion 14 for accommodating the lever 50. The first housing 12 has a rectangular shape with lateral dimension slightly larger than a vertical dimension as shown in FIG. 1 when viewed from front.

Figure 2:
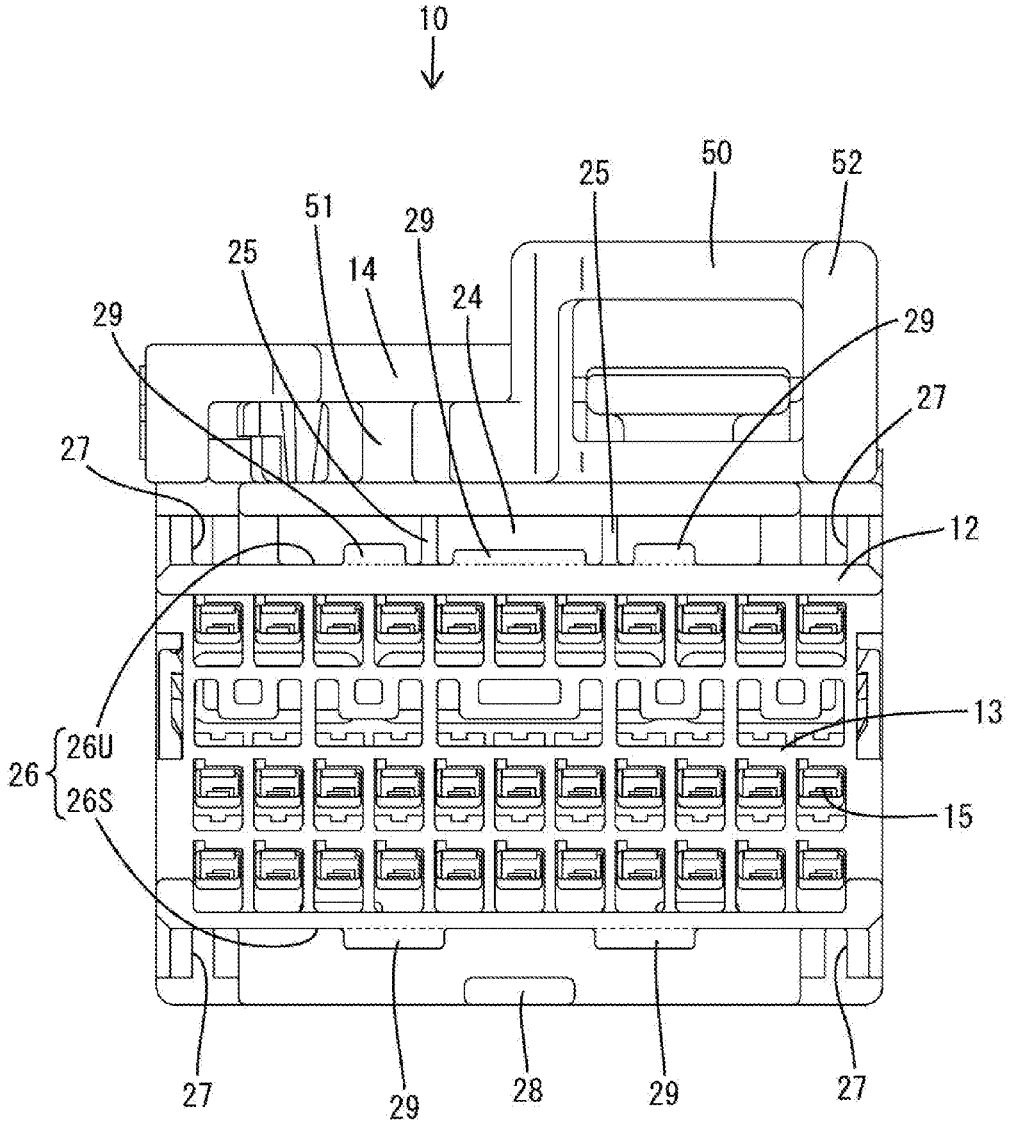
FIG. 2 is a rear view showing the first connector in a state where a wire cover is not mounted.

As shown in FIG. 2, terminal accommodating chambers 15 are provided in the terminal accommodating portion 13 for individually accommodating the first terminal fittings 11. The terminal accommodating chambers 15 are arranged side by side in the lateral direction in each of a plurality of stages divided in a vertical direction. Equal numbers of terminal accommodating chambers 15 are arranged at the same interval in the lateral direction in each stage.

The first terminal fitting 11 connected to an end part of a wire W is inserted and accommodated into each terminal accommodating chamber 15 from behind. The first terminal fitting 11 inserted to a proper position into the terminal accommodating chamber 15 is locked and retained by an unillustrated locking lance provided at the terminal accommodating chamber 15. With the first terminal fitting 11 accommodated in each terminal accommodating chamber 15, the wire W is pulled out from the rear surface of the first housing 12.

A front holder 17 is mounted on a front surface of the terminal accommodating portion 13 (see FIG. 1). The front holder 17 is shaped to cover substantially the entire the front surface of the terminal accommodating portion 13. The front holder 17 constitutes the front wall of each terminal accommodating chamber 15 and closes a front end of a lightening portion 24 to be described later.

A retainer 18 for locking the first terminal fittings 11 and secondarily retaining them is mounted in the terminal accommodating portion 13 (see FIG. 6). The retainer 18 is mounted in a retainer mounting portion 19 provided in a substantially central part of the terminal accommodating portion 13 in the front-back direction. The retainer mounting portion 19 is open on a lower surface of the terminal accommodating portion 13 and vertically communicates up to the terminal accommodating chambers 15 in the uppermost stage. The retainer 18 mounted in the retainer mounting portion 19 is vertically movable between a partial locking position where parts for locking the first terminal fittings 11 are retracted down from the terminal accommodating chambers 15 and a full locking position where the parts for locking the first terminal fittings 11 are located in the terminal accommodating chambers 15.

As shown in FIGS. 1 and 3, the fitting ribs 21 project on the lower surface of the first housing 12 and can fit into the fitting grooves 48 in the second connector 40 and the erroneous connection preventing rib 22 can fit into the groove 47. The fitting ribs 21 and the erroneous connection preventing rib 22 are described in detail later.

Guide grooves 23 are provided on opposite left and right surfaces of the first housing 12 and can receive the guide ribs 49 of the second connector 40. The guide grooves 23 also are described in detail later.

The lightening portion 24 is provided in a part of the first housing 12 located inwardly of the guide grooves 23 (see FIG. 2). The lightening portion 24 is formed into a rectangular shape flat in the lateral direction when viewed from behind, and penetrates through the terminal accommodating portion 13 of the first housing 12 in the front-back direction.

The lightening portion 24 is provided with reinforcing walls 25. The reinforcing walls 25 are coupled to the upper and lower surfaces of the lightening portion 24, stand substantially vertically and divide the lightening portion 24 in the lateral direction. As shown in FIG. 2, two the reinforcing walls 25 are provided at positions displaced from guiding ribs 29 on an upper slide portion 26U to be described later in the lateral direction. The reinforcing walls 25 are provided continuously upward from partition walls between the terminal accommodating chambers 15.

Figure 4:
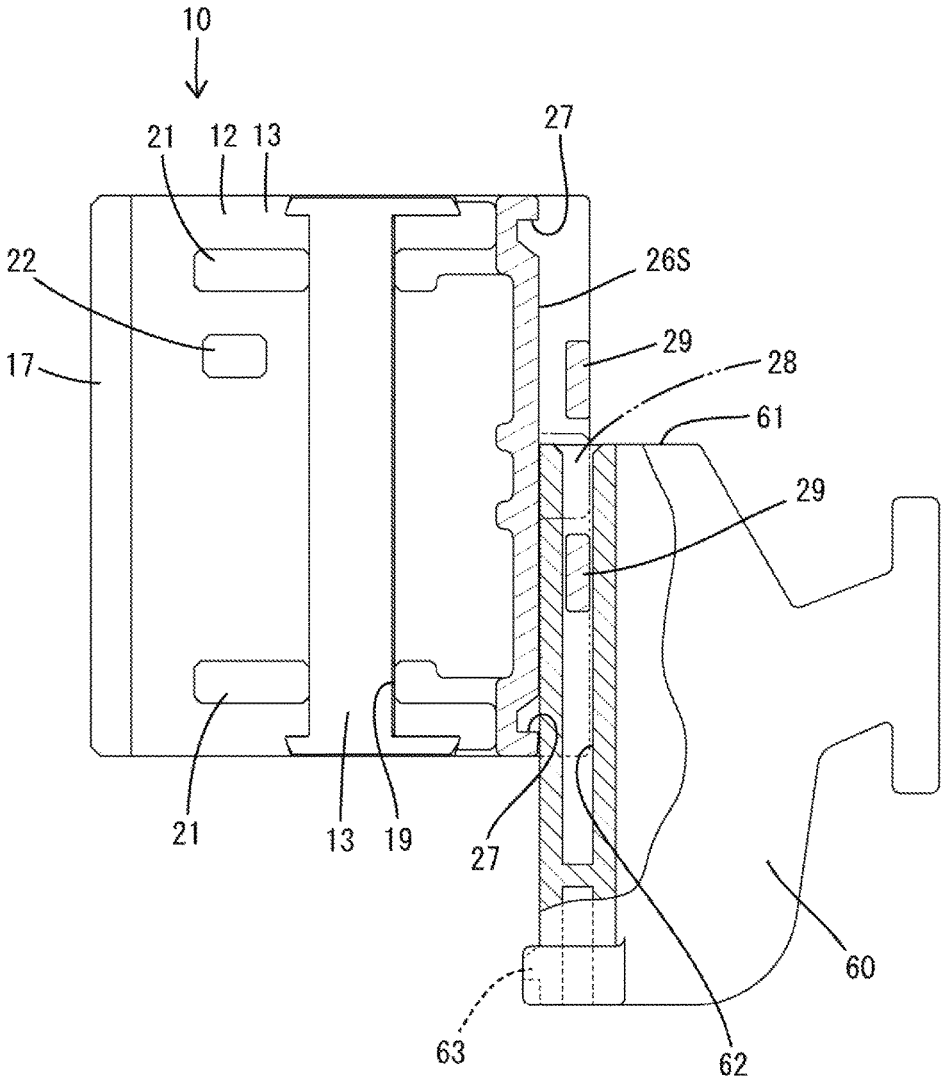
FIG. 4 is a plan view partially cut away and in section showing a state of mounting the wire cover on the first connector.
Figure 5:
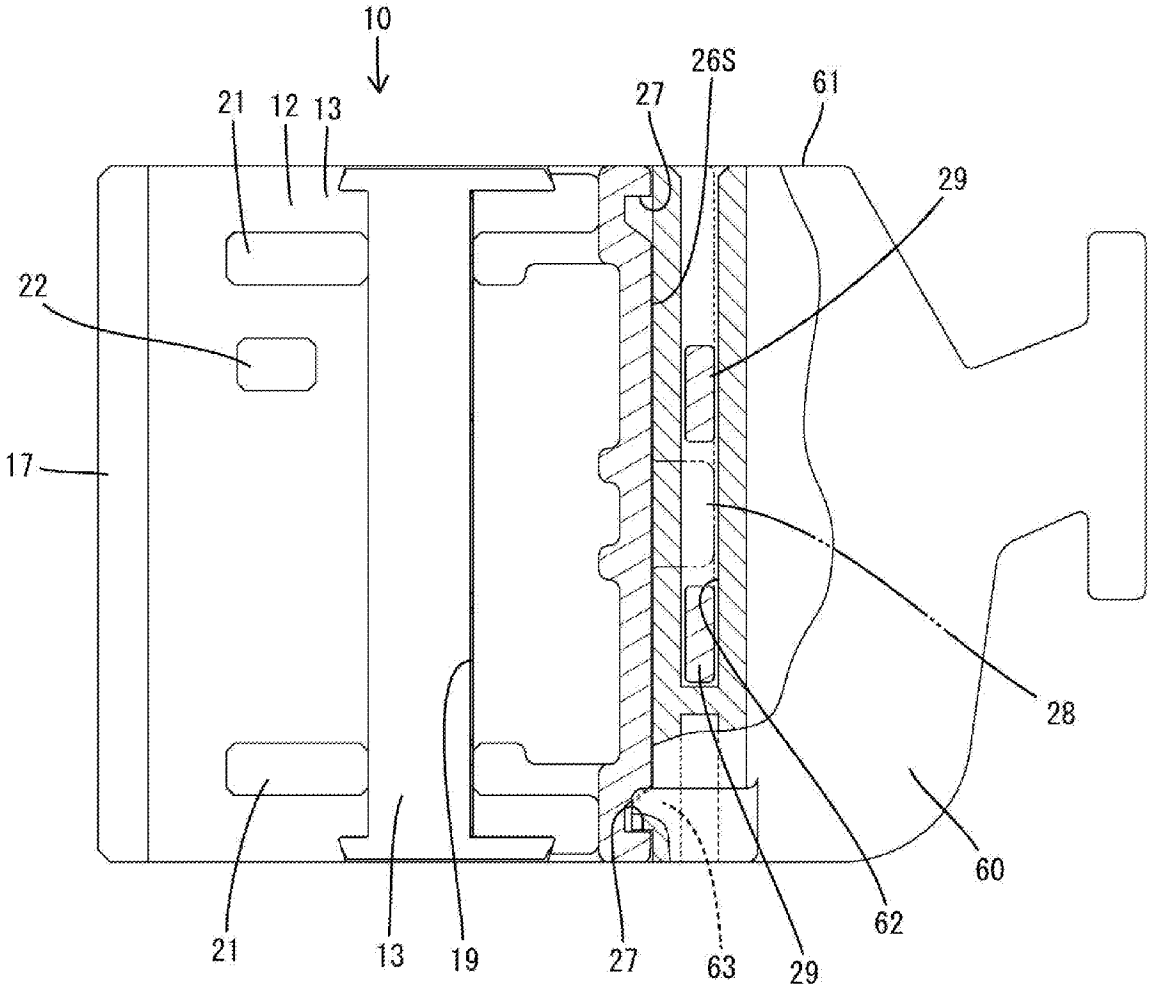
FIG. 5 is a plan view partially cut away and in section showing a state where the wire cover is mounted on the first connector.
Figure 6:
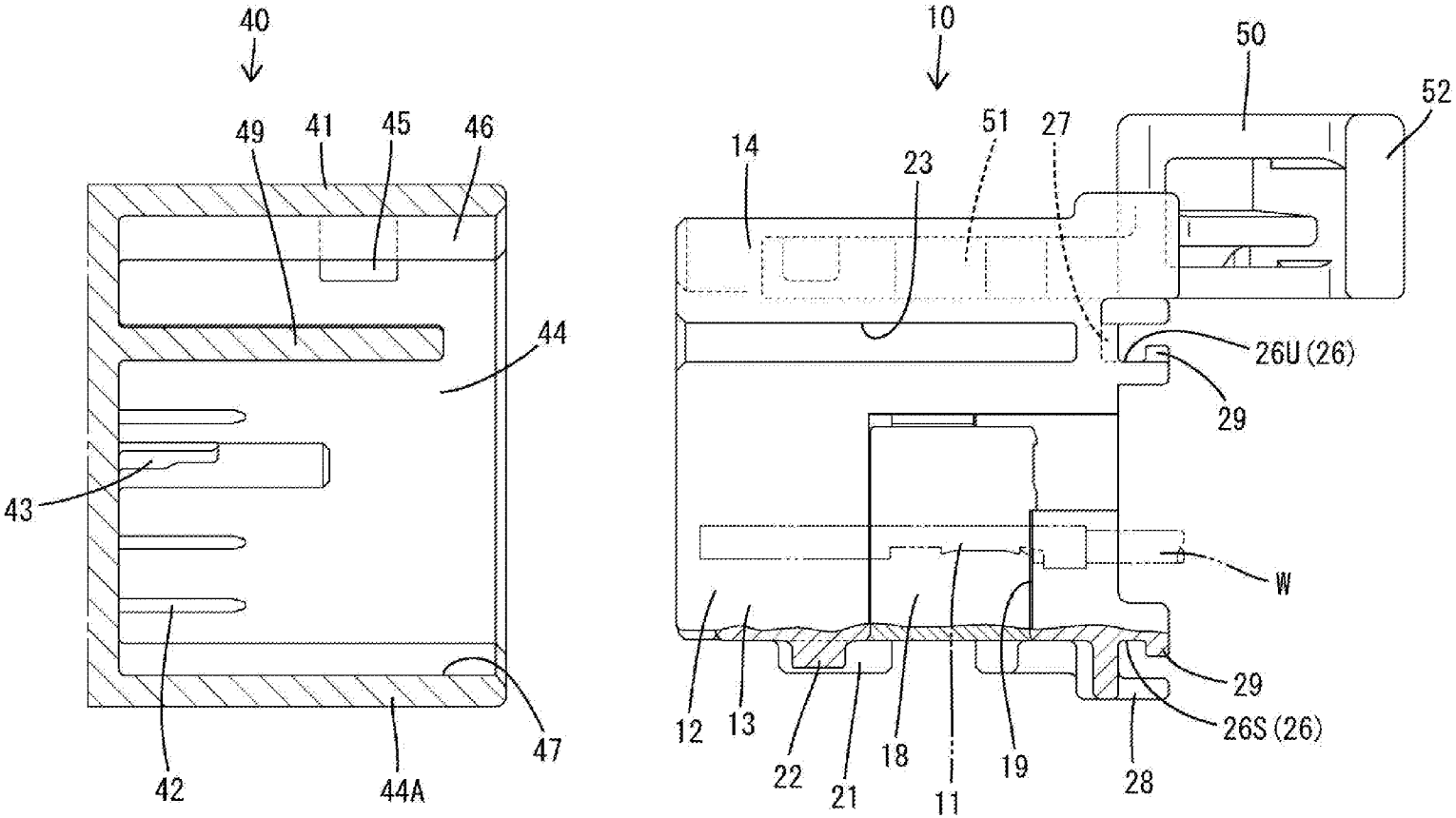
FIG. 6 is a side view partially cut away and in section showing a state before the first connector without the wire cover being mounted thereon is connected to the second connector.

As shown in FIGS. 4 and 5, a wire cover 60 is slid laterally (vertically in FIG. 4) onto the rear surface of the first housing 12 for covering pulled-out parts of the wires W. Slide portions 26 on the rear surface of the first housing 12 slidably engage a front edge part of the wire cover 60 and is locked thereto in the lateral direction.

Figure 12:
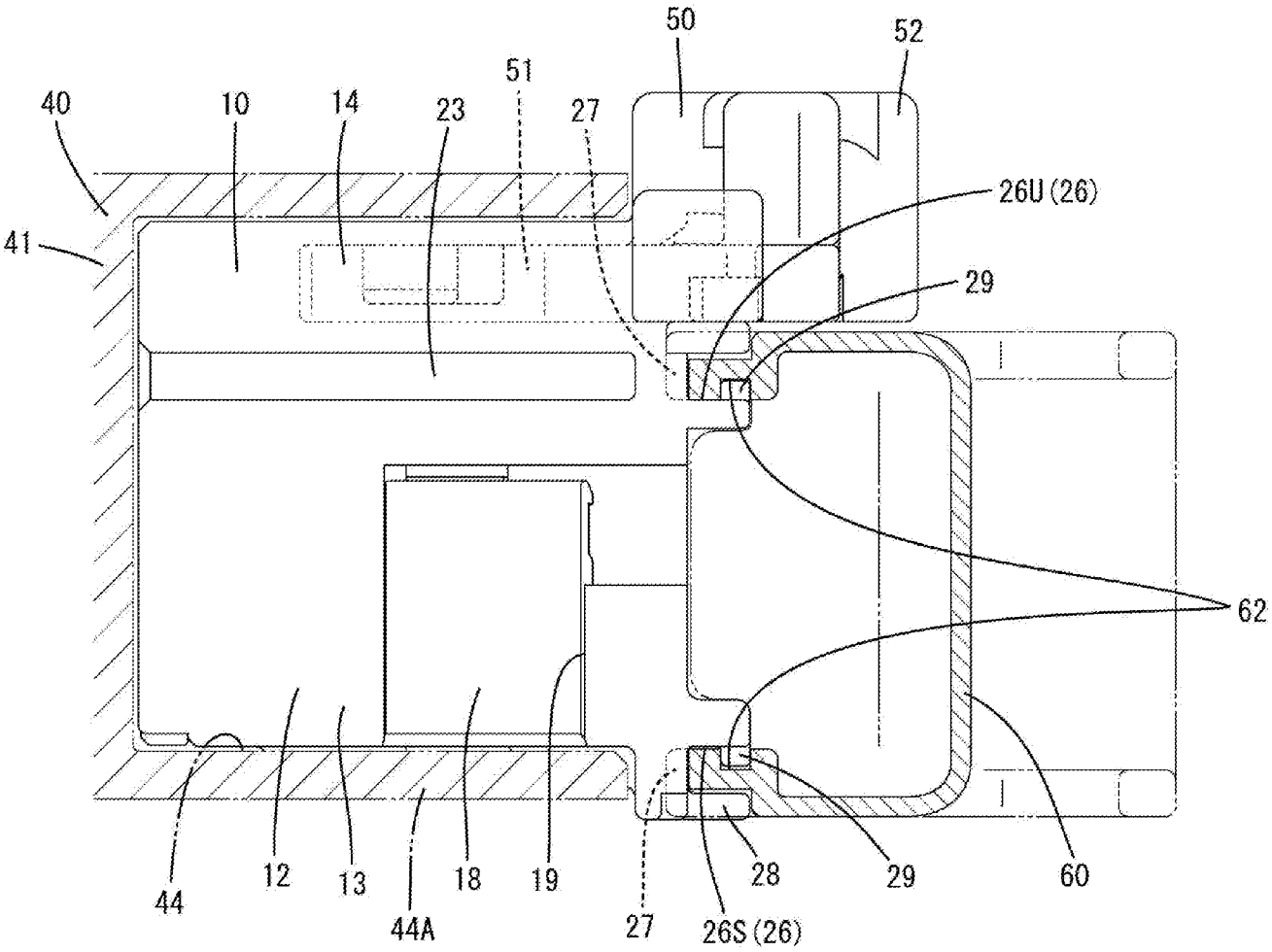
FIG. 12 is a side view in section showing the state where the first connector having the wire cover mounted thereon is properly connected to the second connector.

As shown in FIG. 12, the slide portions 26 are provided on opposite upper and lower sides of the first housing 12 and are spaces open to the back, left and right. Thus, the wire cover 60 can be mounted on the first housing 12 in either lateral posture thereof. As shown in FIGS. 4 and 5, cover locks 27 are provided on opposite left and right ends of each slide portion 26 and lock to cover locking pieces 63 of the wire cover 60.

The slide portion 26 on the upper side (hereinafter, the upper slide portion 26U) is at substantially at the same height as the guide grooves 23, as shown in FIG. 12, and a vertical dimension (height) is equal to a dimension of the guide grooves 23 in the same direction. The slide portion 26 on the lower side (hereinafter, a lower slide portion 26S) is provided on the lower surface of the first housing 12 to project slightly down.

The lower wall of the upper slide portion 26U and the upper wall of the lower slide portion 26S extend over the entire width of the first housing 12, as shown in FIG. 2. Further, the upper wall of the upper slide portion 26U extends over the entire width of the first housing 12 except opposite left and right ends. The lower wall of the lower slide portion 26S is provided only in a substantially central part of the first housing 12 in the lateral direction. This lower wall serves as a finger placing portion 28 on which finger easily is placed during a connecting operation to the second connector 40 when the first connector 10 is used without the wire cover 60 mounted thereon.

Each slide portion 26 is provided with the guiding ribs 29 for guiding a sliding movement of the wire cover 60. As shown in FIG. 12, the guide ribs 29 stand on the rear end of each slide portion 26. Further, the guide ribs 29 are provided on each slide portion 26 as shown in FIG. 2. In this embodiment, three guide ribs 29 are provided on the upper slide portion 26U and two guide ribs 29 are provided on the lower slide portion 26S. On the upper slide portion 26U, one guide rib 29 is provided in a substantially lateral center of the first housing 12 and two guide ribs 29 are provided at opposite sides of the one guide rib 29 and face forwardly of the terminal accommodating portion 13 via the lightening portion 24. On the lower slide portion 26S, two of the guide ribs 29 are provided on left and right sides and are at positions displaced in the lateral direction from the finger placing portion 28.

The lever accommodating portion 14 is open backward so that the lever 50 can be assembled from behind. The lever accommodating portion 14 is sized to spread substantially over the entire upper surface of the first housing 12.

Figure 11:
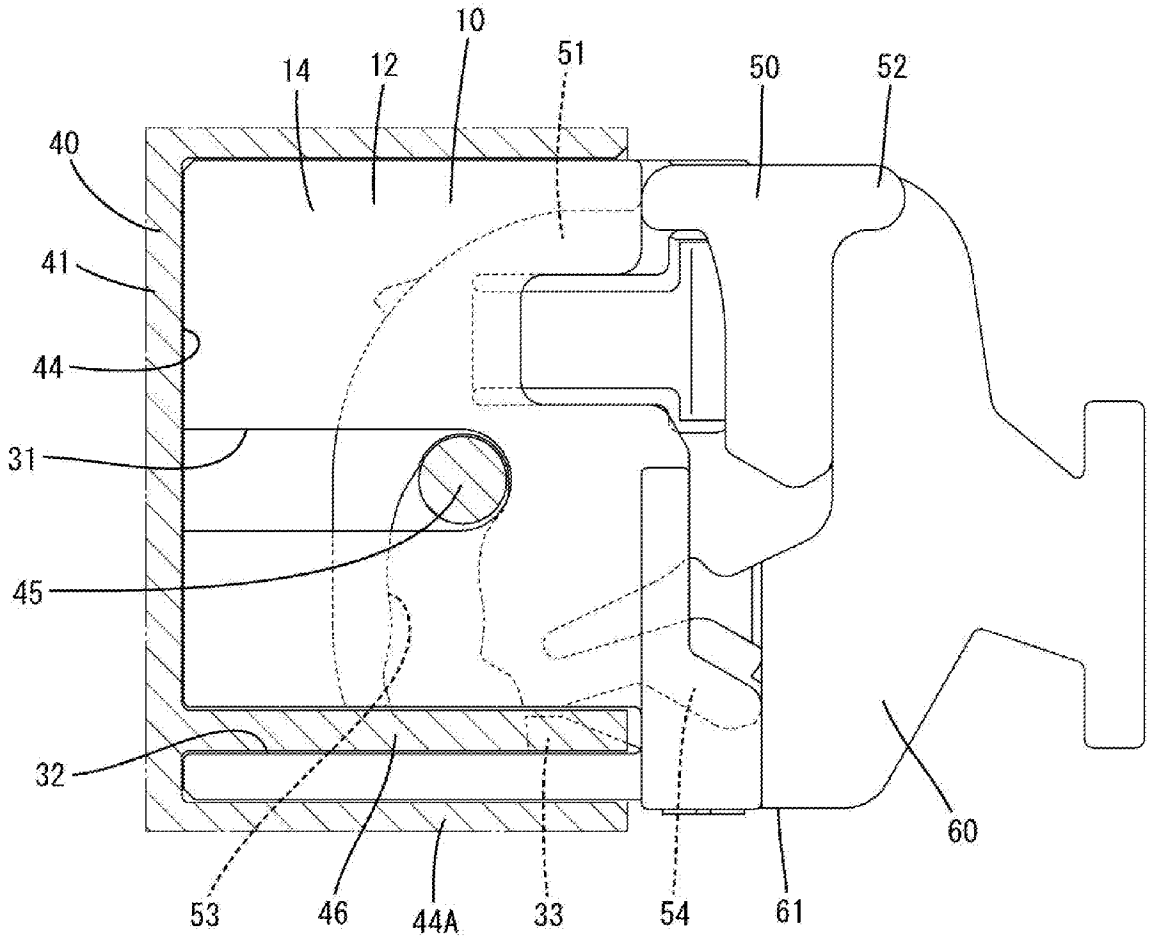
FIG. 11 is a plan view in section showing a state where the first connector having the wire cover mounted thereon is properly connected to the second connector.

As shown in FIG. 11, the lever accommodating portion 14 is provided with a first receiving path 31 for receiving the cam pin 45 of the second connector 40 and a second receiving path 32 for receiving the lock releasing portion 46. Both the first and second receiving paths 31, 32 extend straight back from the front end of the lever accommodating portion 14. The first receiving path 31 is located in a substantially central part of the first housing 12 in a width direction and the second receiving path 32 is located on one end side of the first housing 12 in the width direction.

The lever accommodating portion 14 has a lock receiving portion 33 to which an initial locking piece 54 provided on the lever 50 is lockable. The lock receiving portion 33 projects into the second receiving path 32 at a position near the rear end of the lever accommodating portion 14.

The lever 50 is a rotary lever and includes a flat cam plate 51 made of synthetic resin and an operating portion 52 that can receive a finger for rotating the lever 50. The cam plate 51 of the lever 50 is mounted into the lever accommodating portion 14 with a tiny clearance, and the operating portion 52 projects back from the lever accommodating portion 14.

A cam groove 53 to be engaged with the cam pin 45 of the second connector 40 is formed on the upper surface of the cam plate portion 51. The cam groove 53 is a recess extending toward a center from an end edge of the cam plate portion 51. When the lever 50 is at an initial position, the entrance of the cam groove 53 is located at a front side (left side of FIG. 11) of the first receiving path 31 so that the cam pin 45 can be received into the cam groove 53.

Further, the cam plate portion 51 is provided with the initial locking piece 54 for holding the lever 50 at the initial position by locking the lock receiving portion 33 of the lever accommodating portion 14 when the lever 50 is at the initial position. The initial locking piece 54 is provided to extend in a cantilever manner from the vicinity of the entrance of the cam groove 53 in a rotating direction of the lever 50 (rotating direction of the lever 50 from the initial position to a connection position). A tip part of the initial locking piece 54 in an extending direction is locked to the lock receiving portion 33.

As shown in FIG. 12, the wire cover 60 has a U-shaped cross-section open on a front surface side and is open only on one end side in the lateral direction. The wires W pulled out from the first housing 12 are bent in the wire cover 60 and pulled out from the open side (hereinafter, referred to as a cover opening 61).

As shown in FIGS. 4 and 5, slide grooves 62 into which the guide ribs 29 are inserted are formed to extend in the lateral direction (sliding direction) in a front edge part of the wire cover 60. The slide grooves 62 are provided on opposite upper and lower sides of the wire cover 60, open on one side (on the side of the cover opening 61) in the lateral direction and closed on the other side.

The cover locking pieces 63 to be locked to the cover locking portions 27 of the first housing 12 to hold the wire cover 60 slid to a proper position in position are provided on one end side of the wire cover 60 in the lateral direction. The cover locking pieces 63 are provided on an end part of the wire cover 60 opposite to the cover opening 61 (rear end part in the sliding direction during mounting). The cover locking pieces 63 are cantilevered in a direction opposite to the sliding direction during mounting.

The erroneous connection preventing rib 22 that is inserted into the groove portion 47 provided on the inner side surface of the receptacle 44A during proper connection in which the first connector 10 is connected to the second connector 40 in a correct combination and collides with the receptacle 44A during erroneous connection in which it is attempted to connect the first connector 10 to the second connector 40 in a wrong combination is provided to project on the first connector 10.

As shown in FIG. 1, the erroneous connection preventing rib 22 is provided to project on the lower surface of the terminal accommodating portion 13 of the first housing 12. The position of the erroneous connection preventing rib 22 is aligned with that of the groove portion 47 provided in the connector fitting portion 44 into which each first connector 10 is to be fitted. The erroneous connection preventing rib 22 is fitted into the groove portion 47 when the first connector 10 and the connector fitting portion 44 are connected in a proper combination, whereas the erroneous connection preventing rib 22 collides with the front end of the receptacle 44A to prevent erroneous connection when it is attempted to connect the first connector 10 and the connector fitting portion 44 in a wrong combination.

As shown in FIG. 1, the erroneous connection preventing rib 22 is provided in a substantially right half area when the first connector 10 is viewed from front. The erroneous connection preventing rib 22 has a substantially rectangular cross section in conformity with a cross-sectional shape of the groove portion 47 and projects downwardly. The erroneous connection preventing rib 22 is identically shaped in all the first connectors 10 although the position thereof is different.

Figure 7:
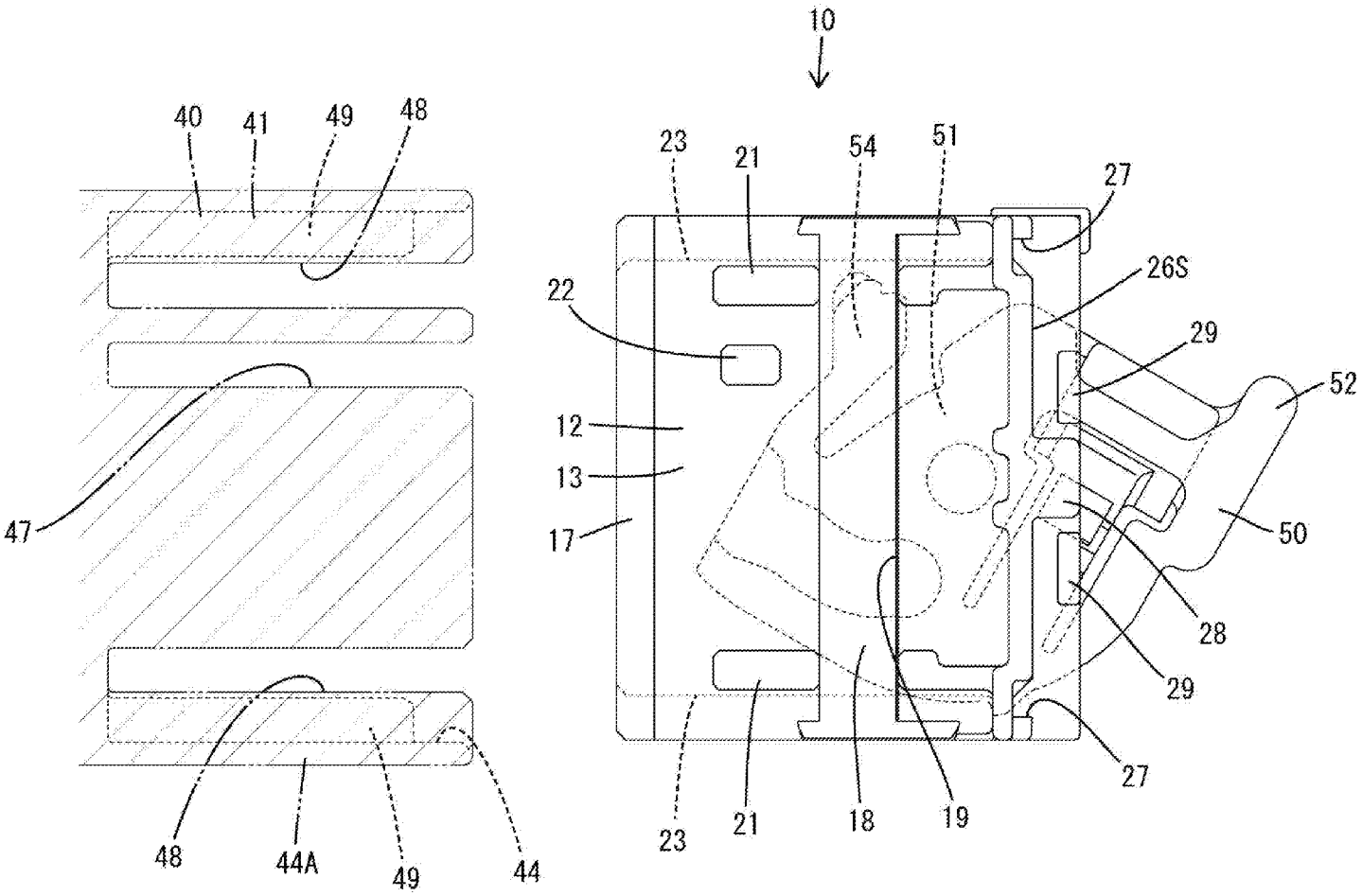
FIG. 7 is a plan view in section showing the state before the first connector without the wire cover being mounted thereon is connected to the second connector.

As shown in FIG. 7, the erroneous connection preventing rib 22 is provided on a front side part of the terminal accommodating portion 13 of the first connector 10. The erroneous connection preventing rib 22 is arranged at a position retreated from the front end surface of the terminal accommodating portion 13. When viewed from below, the erroneous connection preventing rib 22 has a rectangular shape whose dimension in the front-back direction is slightly larger than that in the lateral direction. Note that the rear end of the erroneous connection preventing rib 22 is separated forward from the retainer mounting portion 19.

Further, the first connector 10 is provided with a pair of the fitting ribs 21 to be fitted into the pair of fitting grooves 48 provided on an inner side surface of the receptacle 44A regardless of whether the first connector 10 and the second connector 40 are connected in a correct combination or in a wrong combination.

As shown in FIG. 1, the pair of fitting ribs 21 are provided to project on the lower surface of the terminal accommodating portion 13 of the first housing 12. The pair of fitting ribs 21 are provided at the same positions to have the same shape in all the first connectors 10 to be connected to the second connector 40.

The pair of fitting ribs 21 are provided on opposite end parts of the first connector 10 in the lateral direction and each fitting rib 21 projects downwardly while having a cross-sectional shape conforming to the fitting groove 48 as shown in FIGS. 1 and 3. The pair of fitting ribs 21 are bilaterally symmetrically shaped in the first connector 10. Each fitting rib 21 is fittable into each fitting groove 48. Note that the cross-sectional shape of the fitting ribs 21 is substantially the same as that of the erroneous connection preventing rib 22.

As shown in FIG. 7, the pair of fitting ribs 21 are provided on a part of the terminal accommodating portion 13 before the retainer mounting portion 19. A dimension of each fitting rib 21 in the front-back direction is longer than that of the erroneous connection preventing rib 22 in the front-back direction. The rear end of each fitting rib 21 reaches the opening edge of the retainer mounting portion 19. Further, the front end of each fitting rib 21 is located before the front end of the erroneous connection preventing rib 22 (see FIG. 6). This causes the pair of fitting ribs 21 to be fitted into the pair of fitting grooves 48 before the erroneous connection preventing rib 22 collides with the receptacle 44A. Note that the front and rear end surfaces of the fitting ribs 21 are formed into surfaces substantially perpendicular to the lower surface of the first housing 12 (surfaces substantially orthogonal to a connecting direction of the connectors).

The second connector 40 is provided with the groove portion 47 into which the erroneous connection preventing rib 22 projecting on the lower surface of the first connector 10 is inserted from front and the fitting grooves 48 into which the pair of fitting ribs 21 projecting on the lower surface of the first connector 10 are respectively fittable from front.

As shown in FIG. 3, the groove portion 47 is recessed on the lower wall of the receptacle 44A and the position thereof is different in each connector fitting portion 44. In this embodiment, the groove portion 47 is arranged at a leftmost position in the connector fitting portion 44 located on the left end when the second connector 40 is viewed from front, and the groove portions 47 are arranged at positions successively displaced to the right in the connector fitting portions 44 to the right of the leftmost connecting fitting portion 44. The groove portions 47 are substantially identically shaped in a plurality of connector fitting portions 44. Each groove portion 47 is recessed while having a substantially rectangular cross-section and is formed continuously up to the rear end of the receptacle 44A. Each groove portion 47 is open forward and upward.

As shown in FIG. 3, the fitting grooves 48 are provided at the same positions in all the connector fitting portions 44. A pair of the fitting grooves 48 are provided at opposite left and right sides of the groove portion 47 and arranged at positions near opposite lateral ends of each connector fitting portion 44. Each fitting groove 48 is substantially identically shaped to the groove portion 47 when viewed from front. Each fitting groove 48 reaches the rear end of the receptacle 44A.

As shown in FIG. 6, the first connector 10 is provided with the guide grooves 23 into which the guide ribs 49 projecting on the inner side surfaces of the receptacle 44A are fittable regardless of whether the first and second connectors 10, 40 are connected in a correct combination or in a wrong combination.

As shown in FIG. 3, a pair of the guide ribs 49 are provided on opposite left and right surfaces of each receptacle 44A. The pair of guide ribs 49 are provided substantially at the same height position and at positions closer to an upper end than a center in the vertical direction. The pair of guide ribs 49 are bilaterally symmetrically shaped and each guide rib 49 has such a substantially rectangular shape that a lateral dimension (projecting distance from the receptacle 44A) is slightly larger than a vertical dimension when viewed from front. The lower surface of each guide rib 49 is formed into a substantially horizontal surface standing substantially at a right angle from the inner peripheral surface of the receptacle 44A, and the upper surface thereof is formed into a surface moderately inclined gradually downwardly from an inner end edge (projecting end edge) toward an outer end edge (inner peripheral surface of the receptacle 44A).

As shown in FIG. 6, the guide rib 49 is provided to extend long in the front-back direction (connecting direction of the first and second connectors 10, 40). The guide rib 49 extends straight backward from a position slightly behind the front end of the receptacle 44A and before the cam pin 45. The rear end of the guide rib 49 reaches a back wall (rear end) of the receptacle 44A. Note that the guide rib 49 entirely extends substantially horizontally in the front-back direction.

As shown in FIG. 1, the guide grooves 23 are recessed on the opposite left and right surfaces of the first housing 12 and open forward. The guide ribs 49 projecting on the inner peripheral surface of the receptacle 44A are fitted into the guide grooves 23. The guide grooves 23 are provided at positions close to the lever 50 (positions between the terminal accommodating portion 13 and the lever accommodating portion 14). Each guide groove 23 is formed into a shape matching the guide rib 49 of the receptacle 44A, the lower surface is substantially horizontal and the upper surface is moderately inclined. The pair of guide grooves 23 are located substantially at the same position in the vertical direction and bilaterally symmetrically shaped with respect to a center line of the first housing 12. The pair of guide grooves 23 are located above a center of the first housing 12 in the vertical direction.

As shown in FIG. 6, each guide groove 23 extends backward from the front end of the first housing 12 and the rear end thereof is located at a position near the rear surface of the first housing 12. Note that parts of the first housing 12 behind the guide grooves 23 serve as the cover locking portions 27 to which the cover locking pieces 63 provided on the wire cover 60 are lockable in the lateral direction of the first housing 12.

Next, an example of an operation of connecting the first connector 10 to the second connector 40 is described.

First, the lever 50 of the first connector 10 is set at the initial position and the wire cover 60 is mounted. As shown in FIG. 4, the front edge part of the wire cover 60 is inserted into the slide portions 26 from the left or right end of the first housing 12 while the cover opening 61 of the wire cover 60 is arranged on a front side (lower side of FIG. 4) in the sliding direction and all the wires W are accommodated into the wire cover 60. Then, the guiding ribs 29 of the first housing 12 are inserted into the slide grooves 62 of the wire cover 60. When the wire cover 60 is slid, the wires W are bent in the wire cover 60 and the cover opening 61 of the wire cover 60 reaches the opposite end side of the first housing 12 as shown in FIG. 5. Then, the cover locking pieces 63 are locked to the cover locking portions 27 to restrict a sliding movement in an opposite direction. Further, the guiding ribs 29 reach the closed end parts of the slide grooves 62 to restrict a further sliding movement. Since the guiding ribs 29 and the slide grooves 62 are locked in the front-back direction, the detachment of the wire cover 60 in the front-back direction is restricted. In this way, the mounting of the wire cover 60 is completed.

Figure 8:
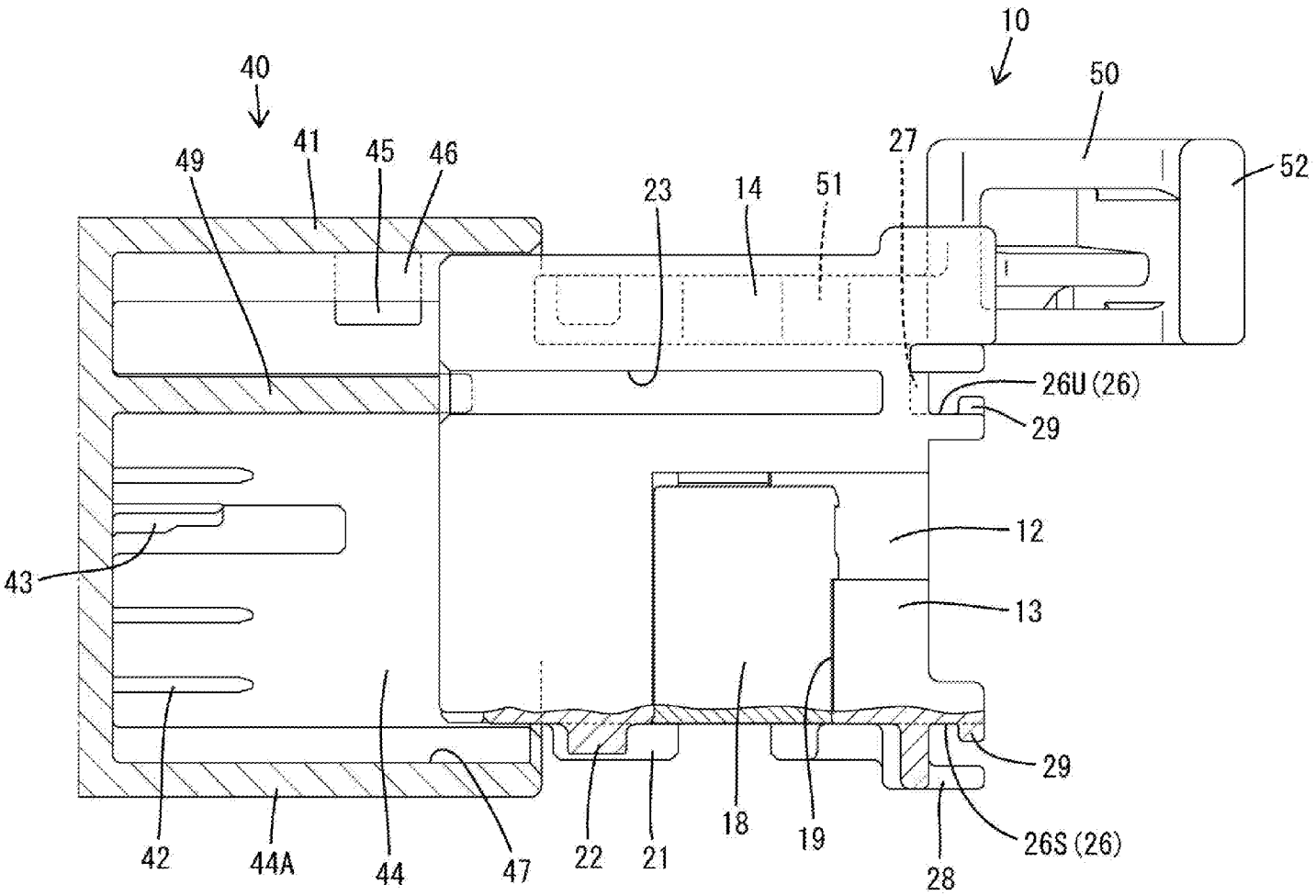
FIG. 8 is a side view partially cut away and in section showing a connector in a state where guide ribs are inserted in guide grooves.
Figure 9:
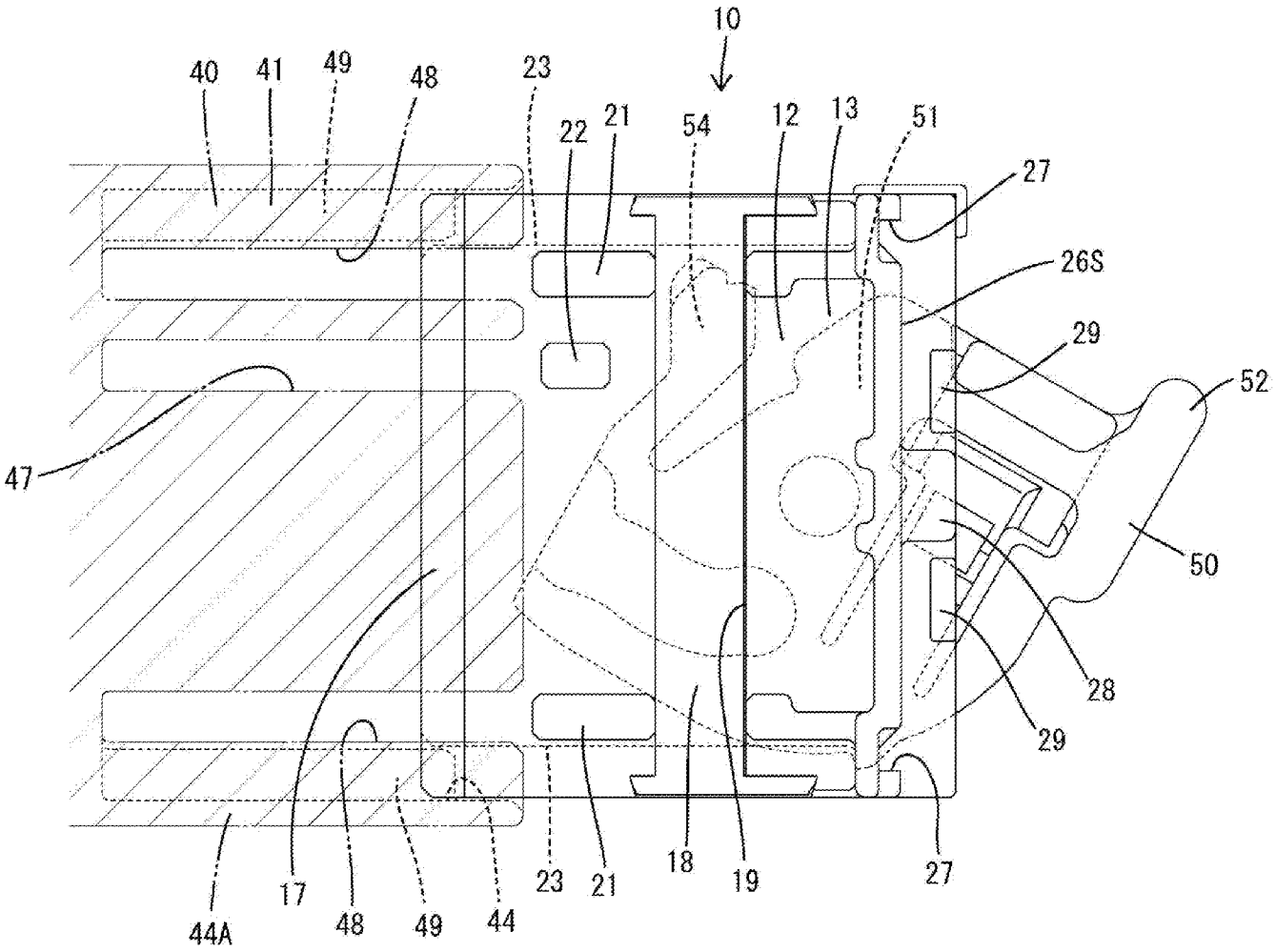
FIG. 9 is a plan view in section showing the connector in the state where the guide ribs are inserted in the guide grooves.

Subsequently, the first connector 10 is lightly fitted into the receptacle 44A of the connector fitting portion 44. Then, as shown in FIGS. 8 and 9, front end parts of the guide ribs 49 are inserted into front end parts of the guide grooves 23 and the front end part of the first housing 12 is fitted into the receptacle 44A to correct a vertical posture of the first housing 12. Then, the pair of fitting ribs 21 are fitted into the pair of fitting grooves 48 to correct a lateral posture of the first housing 12. In this way, the posture of the first connector 10 is determined.

Figure 10:
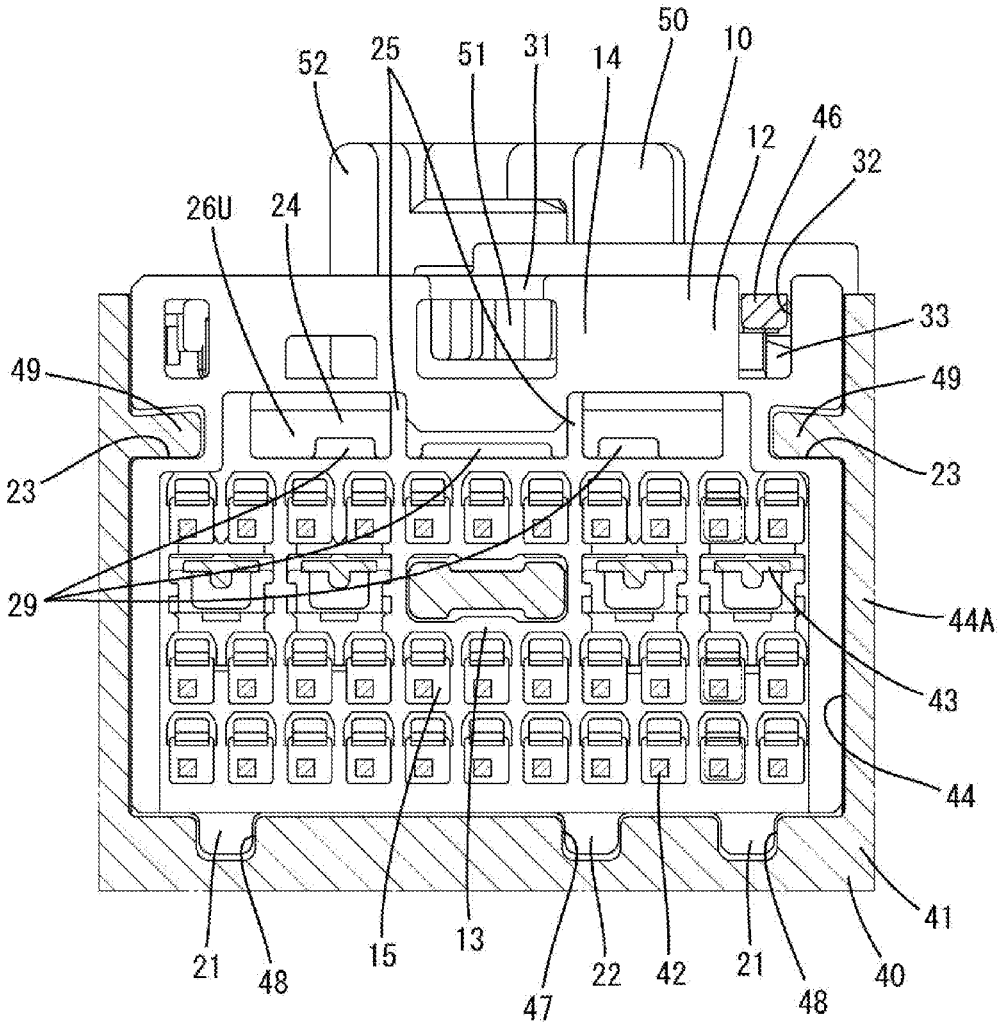
FIG. 10 is a front view partially cut away and in section showing the connector during proper connection.

Thereafter, the erroneous connection preventing rib 22 is inserted into the groove portion 47 to further proceed with connection, the cam pin 45 enters the entrance of the cam groove 53 from the first receiving path 31 and the lock releasing portion 46 enters from the second receiving path 32 to release the locked state of the initial locking piece 54 and the lock receiving portion 33 as shown in FIG. 10 when a combination of the first connector 10 and the second connector 40 is correct. In this way, a state is set where the lever 50 at the initial position is allowed to rotate.

On the other hand, when the combination of the first connector 10 and the second connector 40 is wrong, the erroneous connection preventing rib 22 collides with the front surface of the receptacle 44A to obstruct any further connection, thereby preventing erroneous connection.

Subsequently, the lever 50 is rotated. When the lever 50 is rotated toward the connection position by pressing the operating portion 52 of the lever 50, the first connector 10 is pulled toward the connector fitting portion 44 by a cam action by the engagement of the cam pin 45 and the cam groove 53 and the first connector 10 is further fitted into the receptacle 44A.

In this fitting process, if the upper side of the first connector 10 moves relatively earlier than the lower side to incline the first connector 10 forward, the guide ribs 49 and the guide grooves 23 come into contact in the vertical direction to restrict the inclination. Thus, the first connector 10 moves forward without being inclined in the receptacle 44A, i.e. while being kept in a proper posture in which the first terminal fittings 11 are arranged substantially parallel to the second terminal fittings 42.

When the first connector 10 reaches a proper connection position with respect to the receptacle 44A, the shorted state between the first terminal fittings 11 is released by each short releasing portion 43 and the first terminal fittings 11 and the second terminal fittings 42 are electrically connected. In this way, the operation of fitting the first connector 10 into the connector fitting portion 44 of the second connector 40 is completed. An operation of connecting all the first connectors 10 to the second connector 40 is completed by performing such a fitting operation for three first connectors 10.

Next, functions and effects of the embodiment configured as described above are described.

The connector of this embodiment is configured such that the first connector 10 is fitted into the receptacle 44A of the second connector 40, the erroneous connection preventing rib 22 configured to enter the groove portion 47 provided on the inner side surface of the receptacle 44 during the proper connection in which the first connector 10 is connected to the second connector 40 in a correct combination and collide with the receptacle 44 during the erroneous connection in which it is attempted to connect the first and second connectors 10, 40 in a wrong combination and the pair of fitting ribs 21 to be fitted into the pair of fitting grooves 48 provided on the inner side surface of the receptacle 44A both during proper connection and during erroneous connection are provided on the outer side surface of the first housing 12 of the first connector 10, and the pair of fitting ribs 21 are fitted into the pair of fitting grooves 48 before the collision of the erroneous connection preventing rib 22 with the receptacle 44 during the erroneous connection.

According to this configuration, the erroneous connection preventing rib 22 collides with the receptacle 44A after the pair of fitting ribs 21 are fitted into the pair of fitting grooves 48 to correct the posture of the first connector 10 when it is attempted to erroneously connect the first and second connectors 10, 40. Thus, it can be prevented that the first connector 10 is obliquely inclined to enter the receptacle 44A when the erroneous connection preventing rib 22 collides with the receptacle 44A.

Further, the erroneous connection preventing rib 22 and the fitting ribs 21 are provided on the lower surface of the first housing 12, the guide grooves 23 into which the guide ribs 49 projecting on the inner side surfaces of the receptacle 44A are fittable both during the proper connection and during the erroneous connection are provided on the opposite left and right surfaces of the first housing 12, and the guide ribs 49 are fitted into the guide grooves 23 before the collision of the erroneous connection preventing rib 22 with the receptacle 44A during the erroneous connection.

According to this configuration, if it is attempted to connect the first and second connectors 10, 40 in a wrong combination, the erroneous connection preventing rib 22 collides with the receptacle 44A after the guide ribs 49 are fitted into the guide grooves 23 in addition to the pair of fitting ribs 21 being fitted into the pair of fitting grooves 48. Thus, it can be more reliably prevented that the first connector 10 is obliquely inclined to enter the receptacle 44A.

Further, the guide ribs 49 are provided to extend long in the front-back direction. According to this configuration, the connectors can be connected in correct postures since the posture of the first connector 10 can be prevented from being inclined during connection to the second connector 40.

Further, the lever 50 operated during connection to or separation from the second connector 40 is provided on the upper surface of the first housing 12, and the guide grooves 23 are provided at positions close to the lever 50. According to this configuration, since the guide ribs 49 and the guide grooves 23 come into contact in the vertical direction at the positions close to the lever 50, i.e. at positions where the first connector 10 tends to be inclined forward by the operation of the lever 50, the inclination of the postures of the connectors can be effectively prevented when the connectors are connected.

Further, the front ends of the fitting ribs 21 are located before that of the erroneous connection preventing rib 22. According to this configuration, the pair of fitting ribs 21 are fitted into the pair of fitting grooves 48 before the erroneous connection preventing rib 22 collides with the receptacle 44A even if the front end surface of the receptacle 44A is flat. Thus, the front end surface of the receptacle 44A can be a flat surface without unevenness.

The present invention is not limited to the above described and illustrated embodiment. For example, the following embodiments are also included in the technical scope of the present invention.

Although the erroneous connection preventing rib 22 is described to prevent the first and second connectors 10, 40 from being connected in a wrong connection in the above embodiment, there is no limitation to this and the erroneous connection preventing rib may prevent, for example, the first connector from being fitted in a vertically inverted posture into the connector fitting portion. In that case, the pair of fitting grooves may be provided on the opposite upper and lower surfaces of the receptacle.

Although the connector configured such that the plurality of first connectors 10 are connected to the second connector 40 is described in the above embodiment, there is no limitation to this and the present invention can be also applied, for example, to such a connector that a second connector and a first connector are connected one to one.

The second connector 40 is a board connector in the above embodiment. However, the invention also can be applied to cases where a second connector is not a board connector.

The guide grooves 23 are provided on the opposite left and right side surfaces of the first housing 12 in the above embodiment. However, a guide groove may be provided only on one of the surfaces of the first housing.

The erroneous connection preventing rib 22 is on the lower surface of the first connector 10 and the groove 47 is provided on the lower wall of the second connector 40 in the above embodiment. However, the erroneous connection preventing rib may be on the upper or side surface of the first connector and the groove may be provided on the upper or side wall of the second connector to correspond to the position of the erroneous connection preventing rib.

Although the lever 50 is provided on the first connector 10 in the above embodiment, there is no limitation to this and the present invention can be applied to connectors including no lever.

The front ends of the fitting ribs 21 are located before the front end of the erroneous connection preventing rib 22 in the above embodiment. However, front ends of the erroneous connection preventing rib and the fitting ribs may be at the same longitudinal position and the front surface of the receptacle may be shaped to be uneven. For example, a part to be brought into contact with the erroneous connection preventing rib during the erroneous connection may be recessed backward from other parts.

The fitting ribs 21 are fit into the pair of fitting grooves 48 after the fronts of the guide ribs 49 are inserted into the front ends of the guide grooves 23 when the first connector 10 is fit lightly into the receptacle 44A of the connector fitting portion 44 in the above embodiment. However, the fitting ribs may be fit into the fitting grooves before the guide ribs enter the guide grooves.

LIST OF REFERENCE SIGNS

10 . . . first connector
11 . . . first housing
21 . . . fitting rib
22 . . . erroneous connection preventing rib
23 . . . guide groove
40 . . . second connector
44A . . . receptacle
47 . . . groove
48 . . . fitting groove
49 . . . guide rib
50 . . . lever

What is claimed is:

1. A connector assembly comprising:

a first connector with a first housing having opposite front and rear ends, an erroneous connection preventing rib and fitting ribs provided on an outer surface of the first housing, the fitting ribs having front ends, the erroneous connection preventing rib having a front end that is farther from the front end of the first housing than the front ends of the fitting ribs; and a second connector with a receptacle configured to receive the first housing, an erroneous connection preventing groove and fitting grooves provided on an inner surface of the receptacle, the erroneous connection preventing groove being disposed to receive the erroneous connection preventing rib during proper connection of the first and second connectors and to collide with the receptacle during an erroneous connection, the fitting grooves being disposed to receive the fitting ribs both during the proper connection and during the erroneous connection, and to receive the fitting ribs before the collision of the erroneous connection preventing rib with the receptacle during the erroneous connection, wherein insertion of the fitting ribs in the fitting grooves achieves proper alignment of the first housing with the receptacle and ensures that the erroneous connection preventing rib will collide with a front end of the receptacle during an erroneous connection attempt.

2. The connector of claim 1, wherein:

the erroneous connection preventing rib and the fitting ribs are provided on an upper or lower surface of the housing.

3. The connector of claim 2, further comprising a guide groove formed on a left or right surface of the housing, and a guide rib projecting on the inner surface of the receptacle at a position to fit in the guide groove both during the proper connection and during the erroneous connection, the guide rib further being disposed to fit into the guide groove before the collision of the erroneous connection preventing rib with the receptacle during the erroneous connection.

4. The connector of claim 3 wherein the guide rib has a front end that is closer to the front end of the first housing than the front end of the erroneous connection preventing rib.

5. The connector of claim 3, wherein the front ends of the fitting ribs are spaced from the front end of the first housing by first distances that are equal to one another.

6. The connector of claim 5, wherein the front end of the guide rib is spaced from the front end of the first housing the first distance.

7. The connector of claim 3, wherein the guide rib has a longitudinal direction that extends in a connecting direction.

8. The connector of claim 7, further comprising a lever movably mounted on the upper or lower surface of the first housing and being operated during connection or separation of the first and second connectors.

9. The connector of claim 8, wherein the guide groove is provided at a position close to the lever.

10. A connector assembly comprising:

first and second housings of substantially identical sizes, each of the first and second housings having opposite front and rear ends, an erroneous connection preventing rib and fitting ribs provided on outer surfaces of the first and second housings, positions of the fitting ribs on the first housing being substantially the same as positions of the fitting ribs on the second housing, a position of the erroneous connection preventing the fitting rib on the first housing being different than a position of the erroneous connection preventing rib on the second housing, each of the fitting ribs having a front end, the erroneous connection preventing rib of each housing having a front end that is farther from the front end of the first housing than the front ends of the fitting ribs; and a second connector with first and second receptacles configured to at least partially receive the first and second housings respectively, each of the receptacles having an erroneous connection preventing groove and fitting grooves on inner surfaces of the receptacles, positions of the fitting grooves in the first receptacle being substantially the same as positions of the fitting grooves in the second receptacle, the erroneous connection preventing groove in the first receptacle being disposed to receive the erroneous connection preventing rib of the first housing, the erroneous connection preventing groove in the second receptacle being disposed to receive the erroneous connection preventing rib of the second housing, wherein insertion of the fitting ribs in the fitting grooves achieves proper alignment of the first and second housing with either of the first and second receptacles and ensures that the erroneous connection preventing rib will collide with a front end of the receptacle during an erroneous connection attempt.

* * * * *